United States Patent [19]

Fry et al.

[11] 3,970,550

[45] July 20, 1976

[54] MOULDED ELASTOMERIC SCREEN MAT FOR SIEVING DEVICES

[75] Inventors: Sidney Fry, Cleckheaton; Terence Edward Crabtree, Brighouse; Brian Rothery, Queensbury, all of England

[73] Assignee: BBA Group Limited, Checkheaton, England

[22] Filed: June 7, 1974

[21] Appl. No.: 477,263

Related U.S. Application Data

[63] Continuation of Ser. No. 327,448, Jan. 29, 1974, abandoned.

[30] Foreign Application Priority Data

Jan. 28, 1972 United Kingdom ..... 4161/72

[52] U.S. Cl. ..... 209/399

[51] Int. Cl.[2] ..... B07B 1/49

[58] Field of Search ..... 209/392, 393, 394, 395, 209/396, 397, 398, 399, 400, 401, 402, 403, 404, 405

[56] References Cited

UNITED STATES PATENTS

| | | | |
|---|---|---|---|
| 1,718,385 | 6/1929 | Sherwood | 209/397 |
| 2,740,525 | 4/1956 | Wehner | 209/399 |
| 3,483,976 | 12/1969 | Williams | 209/395 |
| 3,684,091 | 8/1972 | Wehner | 209/405 |
| 3,833,120 | 9/1974 | Ogata | 209/399 |

FOREIGN PATENTS OR APPLICATIONS

| | | | |
|---|---|---|---|
| 1,965,005 | 7/1970 | Germany | 209/399 |
| 116,655 | 4/1969 | Norway | 209/399 |
| 241,350 | 4/1969 | U.S.S.R. | 209/392 |

*Primary Examiner*—Harrison L. Hinson
*Attorney, Agent, or Firm*—Stevens, Davis, Miller & Mosher

[57] ABSTRACT

A screen mat having a moulded elastomeric body and at least one elongated tensioning member extending through said body along a path remote from the side edges of the body, the member or members being intended to tension the screen mat in use to restrain flexibility of the body, and in which the body comprises a screen part having substantially parallel upper (screening) and lower (underside) surfaces between which the apertures of the screen communicate and at least one rib which is integral with the screen part and stands proud of one of said surfaces, and wherein the tensioning member or members extend through the body substantially parallel with the surfaces and are located nearer to one of the surfaces than to the other and the rib or ribs are substantially co-extensive with, and overlie, the tensioning member or members substantially over their extent through the body.

6 Claims, 9 Drawing Figures

MOULDED ELASTOMERIC SCREEN MAT FOR SIEVING DEVICES

This is a continuation of application Ser. No. 327,448, filed Jan. 29, 1973, now abandoned.

This invention relates to a screen which is used to separate and grade various sizes of particles of raw material comprising rocks, chemicals, mineral ores or the like.

Such a screen (which is frequently termed, and will be referred to hereinafter as, a "screen mat") is provided with an array of apertures which extend throughout the thickness of the mat so that particles of raw material with overall dimensions which are less than that of the apertures are able to pass freely through the screen mat whilst the larger particles of raw material are retained on the upper (screening) surface of the screen mat. In order to facilitate the passage of the particles of raw material through the apertures, the screen mat is usually attached to a screen deck in the form of a metal frame which is continually or intermittently vibrated or rotated in a plane which may be vertical, horizontal or inclined at an angle to the horizontal. By this means it is thus possible to grade a sample of raw material into particles of varying sizes.

Heavy duty screen mats, for the sieving especially of mined and quarried products, are increasingly being made from rubber or other elastomeric material because of the excellent wear resistance of these materials and also because they have the advantage of relative quietness in use. A disadvantage is that, compared with a perforated steel sheet screen mat or with a woven wire screen mat, screen mats of natural or synthetic rubber, or of other elastomers such as polyurethane, are liable to be too flexible and, when used on a vibrating screen deck, are liable to show a much greater amplitude of vibration than steel or woven wire screen mat which vibration tends to reduce their efficiency and life. Further, the extensibility of elastomers prevents them from being adequately tensioned.

Various methods have hitherto been proposed to overcome the problem of over-flexibility in screen mats of elastomeric material, including moulding (for example by casting) steel bars or wire lattices into the screen mat material. One commonly used method, is to mould wire cables into the screen for example, as is discussed in U.S. Pat. No. 1,258,204; these cables extend to, and generally protrude from the screen at, each side edge, and are tensioned by devices on the frame of the screen deck when in service. Screen mats having the aforementioned steel cable tensioning members are satisfactory for heavy duty, thick and coarse mesh screen mats (generally used for large stones or coarse minerals). However, fine mesh screen mats used for such materials as sand should be much thinner to give reasonable sieving efficiency owing to the very small holes in the screen. With this type of fine screen mat the thickness of the steel cable embedded in the screen mat substantially reduces the effective wearing thickness of the elastomeric material before the cable is exposed, thereby restricting the effective service life of the screen mat.

It is an object of the present invention to provide a screen mat having improved means by which the aforementioned problem of over-flexibility in the screen mat may be alleviated.

According to the present invention there is provided a screen mat having a moulded elastomeric body and at least one elongated tensioning member extending through said body along a path remote from the side edges of the body, said member or members being intended to tension the screen mat in use to restrain flexibility of the body, and in which the body comprises a screen part having substantially parallel upper (screening) and lower (underside) surfaces between which the apertures of the screen communicate and at least one rib which is integral with the screen part and stands proud of one of said surfaces, and wherein the tensioning member or members extend through the body substantially parallel with said surfaces and are located nearer to one of said surfaces than to the other and the said rib or ribs are substantially co-extensive with, and overlie, the said tensioning member or members substantially over their extent through the body.

Preferably the tensioning member or members are located at least partly in the said rib or ribs so that the tensioning members are, for their longitudinal extent which passes through a rib or ribs, either wholly enclosed over their peripheral surface by the elastomeric material of the rib or enclosed over part only (preferably the major part) of their peripheral surface by the elastomeric material of the rib and over the remaining part of their peripheral surface by elastomeric material of the screen part. Alternatively the tensioning member or members may be located wholly in the screen part, preferably nearer to the surface which carries the ribs than to the other surface; for example if a tensioning member is of cylindrical form its circumference may coincide with or lie immediately above the surface of the screen which carries the rib or ribs and in this case the ribs (which need only be very shallow) extend along the line of the tensioning member to ensure that it is properly sealed and enveloped in the elastomeric body of the screen mat.

Generally the rib or ribs, which may be of any suitable cross-sectional shape, will be moulded in the body so that they will extend downwardly from the underside or lower surface of the screen part when the screen mat is in use. Consequently the screen part may be moulded to a thickness which suits its intended sieving requirements and the screen mat will remain serviceable for longer than conventional tensionable screen cloths because the whole or major part thickness of the apertured screen part is available for wear before the tensioning member is likely to become exposed through the upper or screening surface.

Generally the screen part of the screen mat will be of rectangular shape in plan and the tensioning member will extend through the body, either widthwise or lengthwise, preferably parallel to and spaced from a pair of opposed side edges of the rectangular shape. Usually, but not essentially, the rib or ribs will extend across the full width or length of the screen part so that the tensioning member or members will be enclosed within the elastomeric material of the body for the whole of its longitudinal extent which overlies or underlies one or both surfaces of the screen part.

When more than one elongated tensioning member is provided in the body, the tensioning members will usually be in spaced relationship and parallel to each other and located in or overlie discrete ribs which are preferably all on the same surface side of the screen part. If required a single tensioning member can meander through, preferably into and out of, the body, so that part lengths of its longitudinal extent which are embedded in the elastomeric material of the body are located in or overlie discrete and parallel ribs which are preferably all on the same surface side of the screen part.

The screen mat is preferably made by casting the rubber or rubber-like material such as polyurethane (herein generally referred to as elastomeric material) to form the body over the tensioning member or members, for example, in a similar manner to the cast polyurethane screen mat which is the subject of our copending application No. 2953/70.

The tensioning member or members, which should be inextensible, may be flexible or rigid and are preferably steel or other metallic cables or ropes. However, other tensioning members can be used, for example, metallic rods or wires; or suitable high strength natural or synthetic textile filaments, rods or ropes.

The present invention will now be further described, by way of example only, with reference to the accompanying illustrative drawings in which FIGS. 1 to 3 show a plan, side section and end elevation respectively of part of a conventional screen mat having tensioning members;

Where possible throughout the following description the same parts or members as referred to in each of the Figures have been accorded the same references.

Figure 1:
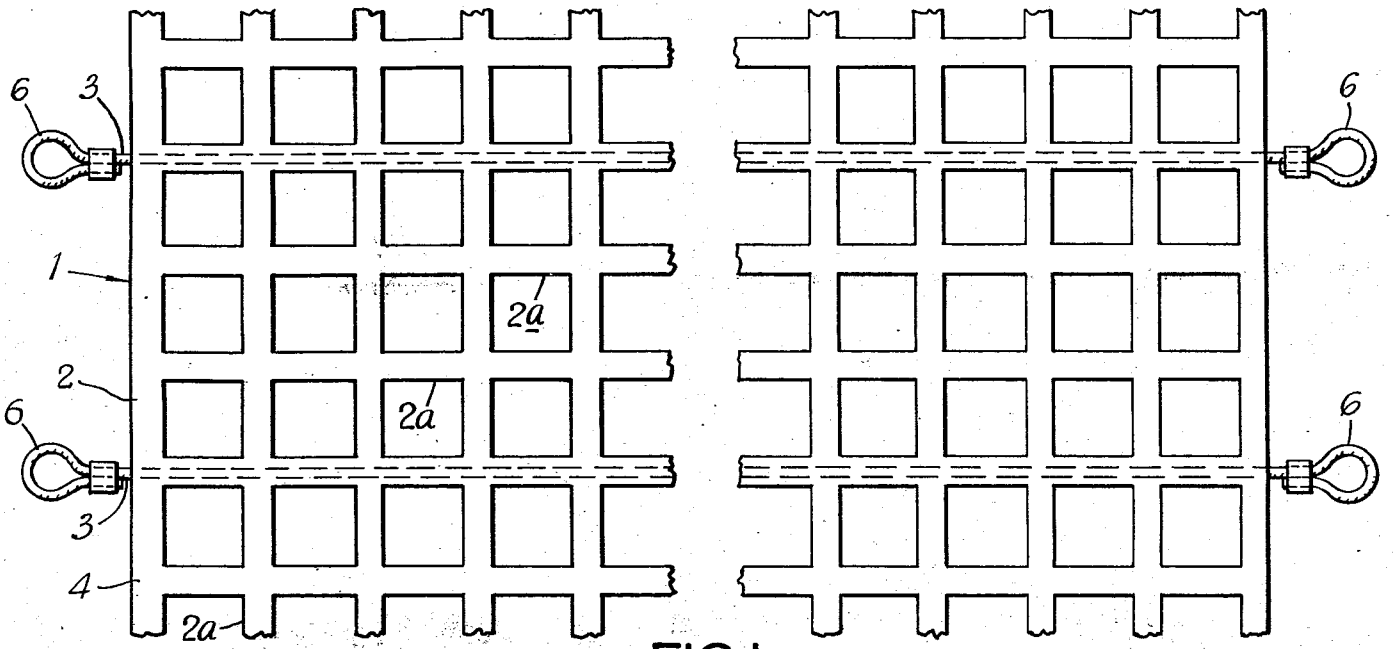
Figure 2:
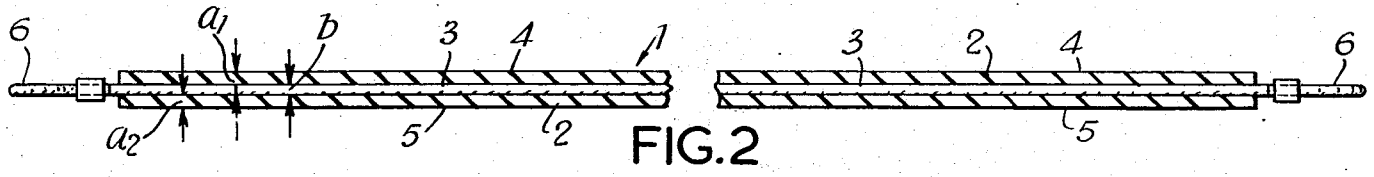
Figure 3:
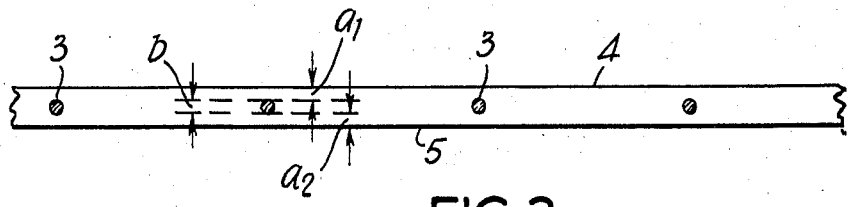

In FIGS. 1 to 3 the conventional screen mat comprises a body 1 which is moulded in, for example, rubber to provide a screen part 2 having sieving apertures 2*a* and to embed within the screen part a spaced and parallel array of steel tensioning cables 3 which project from opposed side edges of the body. The screen part 2 is of rectangular shape in plan and has parallel upper (screening) and lower (underside) plane surfaces 4 and 5 respectively. The cables 3 extend through the full width of the screen part 2 parallel to the surfaces 4 and 5 and parallel to and spaced from a pair of opposed parallel side edges of the aforementioned rectangular shape. Eyes 6 are provided at the ends of cables 3 by which they are intended to be attached to tensioning means when the screen mat is in use on the metal frame of a screen deck. Assuming that the diameter of each cable 3 is $b$ and each cable is embedded by a thickness of rubber $a_1$ from screening surface 4 and by a thickness of rubber $a_2$ from the underside surface 5, it will be seen from FIG. 2 that the total thickness of the screen mat is $a_1 + a_2 + b$ but that only the fractional thickness $A_1$ of the rubber is available for wear before the screen part 2 wears down to the cables (at which time the screen mat will fail rapidly).

Figure 4:
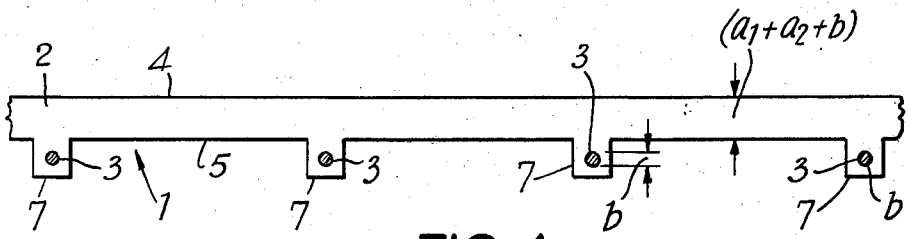
FIGS. 4 and 5 show an end elevation and side section respectively of part of a screen mat constructed in accordance with one embodiment of the present invention, the body of the screen mat being provided with a spaced array of tensioning members.
Figure 5A:
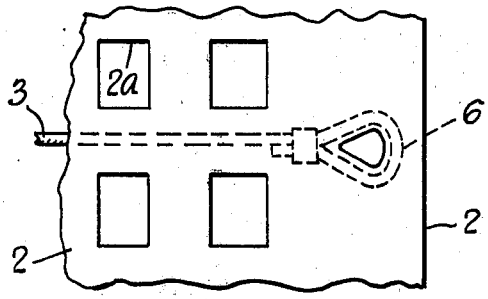
FIG. 5A is a plan view of part of a screen mat constructed in accordance with the invention and illustrates a possible modification to the mat body and ends of the tensioning members.
Figure 5:
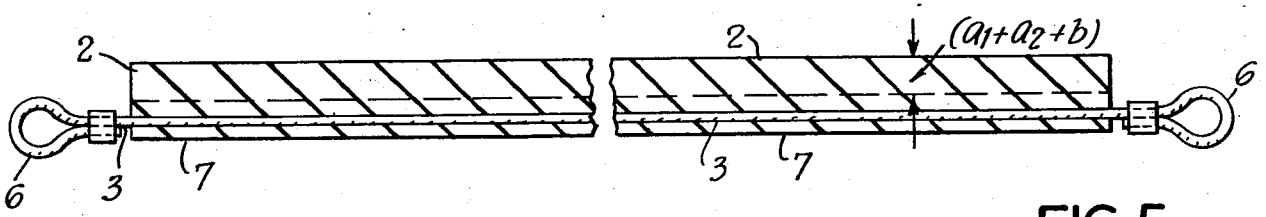

Referring now to the embodiment of the present invention shown in FIGS. 4 and 5, the body 1 is moulded, for example by casting in polyurethane to provide the screen part 2 and a spaced array of rectangularly sectioned ribs 7 which extend downwardly from the underside surface 5. The ribs 7 are integral with the screen part 2, are parallel and extend for the full width of the screen part. The body 1 is moulded over the tensioning cables 3 so that the tensioning cables are located to extend longitudinally through the ribs 7 and the peripheral (substantially cylindrical) surface of each cable is wholly enclosed within the elastomeric material of its respective rib from which it projects at opposed side edges of the cloth.

If, in FIGS. 4 and 5, the thickness of the screen part 2 is the same as in FIG. 2 (i.e., $a_1 + b_1 + a_2$), then for screen mats of similar design, the wearable thickness (almost $a_1 + b + a_2$) of elastomeric material for the screen mat in FIG. 4 is considerably greater than that thickness ($a_1$) for the screen mat in FIG. 2. Consequently even if the bodies of the screen mats in FIGS. 2 and 4 are moulded in the same elastomeric material, the useful working life of the screen mat in accordance with the present invention as shown in FIG. 4 will be substantially greater than that of the conventional screen mat — assuming that both screen mats are used under similar operating conditions.

The above described advantage of available wear thickness of elastomeric material is comparatively greater in thin rather than thick screen parts of the screen mats. For example, in a conventional heavy screen mat having a screen part 2 of 20mm. thickness, steel cable tensioning members of 4mm. diameter are usually located approximately 3mm. from the lower surface 5 of the screen part and consequently there is approximately 13mm. wearing thickness of elastomeric material above the cables. In a screen mat according to the present invention if the screen part 2 is of 20mm. thickness it would be possible to wear this down to approximately 5mm. thickness from the lower underside surface 5, thus providing 15mm. thickness for wear. This shows the relatively small improvement over the 13mm. available wear of the conventional screen mat, of 15% approximately.

With screen mats which provide a much finer sieve, such as may be used for sand, a screen part thickness of about 7mm. would be suitable. In such a conventional fine screen mat, the screen part 2 could be provided with tensioning cables of 3mm. diameter. In a thin moulding of the screen part such as this it is not easy to position the tensioning cables away from the centre of the thickness, of the screen part and there would thus be only approximately 2mm. of effective wearing thickness of elastomeric material above the cables. By comparison with the present invention if the screening part has a thickness of about 7mm. it would be possible to wear this down to approximately 3mm. thickness from the lower underside surface 5, thus providing approximately 4mm. wearing thickness of elastomeric material. This shows an improvement of approximately 100% over the conventional screen mat.

Figure 7:
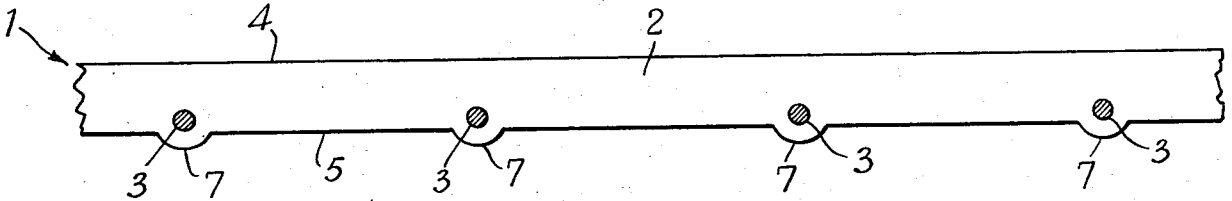
FIG. 7 is an end elevation of a modified screen mat constructed in accordance with the invention in which the tensioning members are located wholly in the screen part.

In the modification shown in FIG. 7 the tensioning cables 3 are located wholly in the elastomeric material of the screen part 2 so that their cylindrical surfaces are substantially tangential to the plane of the lower surface 5. To ensure that the cables 3 are wholly enveloped in elastomeric material, the ribs 7 (which in this instance are part cylindrical) extend downwardly from the underside surface 5 and follow the line of the cables for their extent through the body 1. Even with the cables located in the screen part 2 in this manner it will be apparent from FIG. 7 that a considerable increase in thickness of elastomeric material is provided in comparison with conventionally formed screen mats from the upper screening surface 4 before the cables 3 become exposed.

The screen mats shown in the figures have square apertures. The invention is of course equally applicable to screen mats with round apertures or with slots, or with holes of any desired shape or degree of full or partial taper through the thickness of the screen part 2 from the upper to the lower surfaces 4 and 5 respectively.

A feature of the present invention is that when applied to cast screen mats, there is no appreciable extra complication in the design of the casting die. Such die (as described in our co-pending application No. 2953/70), basically comprises a shallow flat bottomed box having vertical projections in spaced array over the base, so that when the liquid casting material (for example polyurethane) is poured in and sets, the apertures in the screen part of the screen mat correspond to the projections in the base of the casting box. To provide the improved screen mat in accordance with the present invention, all that is necessary is that the base of the box is provided with an array of grooves or channels of complementary shape and extent to the desired profile of the rib or ribs 7. The reinforcing cables, which are preferably pre-treated to improve adhesion with the elastomeric material, are placed in or slightly above these grooves or channels and may then be pretensioned. The grooves or channels and the casting box are then filled by the liquid casting material which is allowed to set and form the ribs overlying the tensioning cables and the screen part.

In the case of moulded screen cloths made in split cavity or closable moulds, similar provisions can be made in mould design without undue difficulty.

In FIGS. 1 to 5, the eyes 6 at the ends of the tensioning cables are formed by clamped loops which are easily attached to tensioning bars for use on conventional screening decks. If required, and in fact it may be preferred that, these clamped loops are encapsulated in elastomeric material (with an aperture through the material within the confines of the loop) to form an integral part with the body of the screen mat; such a modification is illustrated in FIG. 5A. By so encapsulating the loops they will be protected from corrosion and wear. It will be realised however that there are numerous ways in which such tensioning cable ends may be designed as will be apparent to persons skilled in the art.

Figure 6:
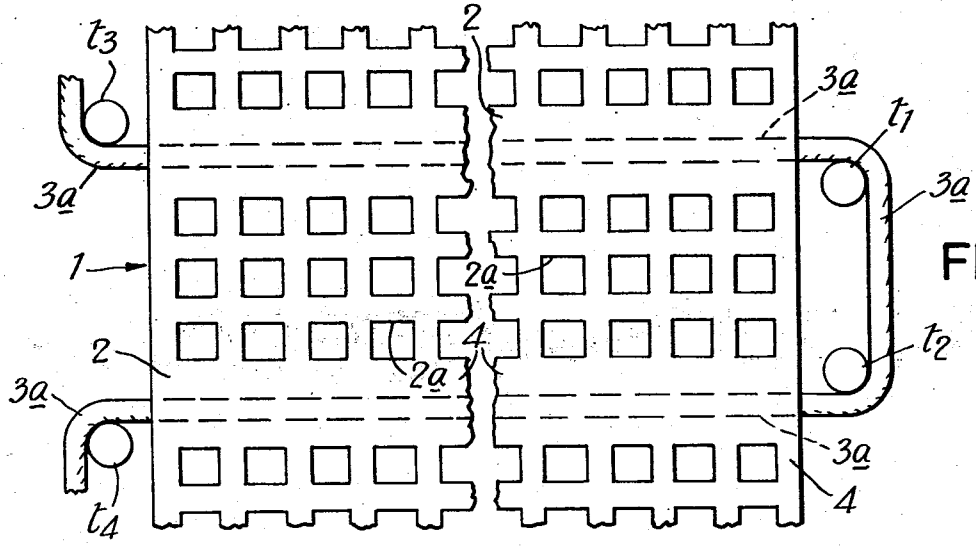
FIG. 6 is a plan view of part of a screen mat constructed in accordance with another embodiment of the present invention, the body of the screen mat being provided with a single meandering tensioning member.

A further embodiment of the present invention is shown in FIG. 6 in which, instead of several separate tensioning cables being provided in the body 1 of the screen mat, a single tensioning cable 3*a* meanders into and out of the body to extend through the ribs 7 (in a similar manner to that shown in FIG. 4) and to have part length portions projecting from a pair of opposed side edges of the body 1. In this case only two clamped loops 6, one at each end of the cable 3*a*, are needed; all the other fastening points of the cable 3*a* being provided at the sides of the screen part 2 by the double or U-portions formed at the side edges of the body 1 by intermediate part lengths of the continuous meandering cable.

When making the screen mat shown in FIG. 6 it is advisable to locate the cable around carefully prefixed pivot points outside the casting box or mould over which points the cable is pre-tensioned to provide a true longitudinal tension in the cable and to ensure that the part lengths of the cable which extend through the ribs remain parallel to each other and correctly positioned in the ribs.

The provision of similar pivot points is also advisable on the tension bars which are used on the metal frame of the screen deck. These pivot points are shown diagrammatically as $t_1$, $t_2$, $t_3$ and $t_4$ in FIG. 6 and are advisable to ensure that the body of the screen mat is not distorted when tensioned.

Although to achieve the advantages of the present invention it is necessary to use a fairly small additional amount of elastomeric material in comparison with conventional screen mats, (that is the amount of material necessary for forming the ribs), this extra material for the body may be important in the case of polyurethane which is a costly material. With this in mind, in a modification of the present invention, the additional amount of elastomeric material needed as aforementioned may be reduced in comparison with the embodiment shown in FIG. 4. This may be accomplished by positioning the tensioning cable 3 so that part of its peripheral surface is located in the material of the screen part 2 and the remaining part of its peripheral surface is located in the material of a rib 7 (i.e., the cross-sectional area of the cable 3 extends above and below the plane of the lower underside surface 5 of the screen part 2). In this way a much smaller rib (which can be V-shaped in section) may be provided to cover that part of the cable which would otherwise protrude below the lower surface 5 of the screen part.

Figure 8:
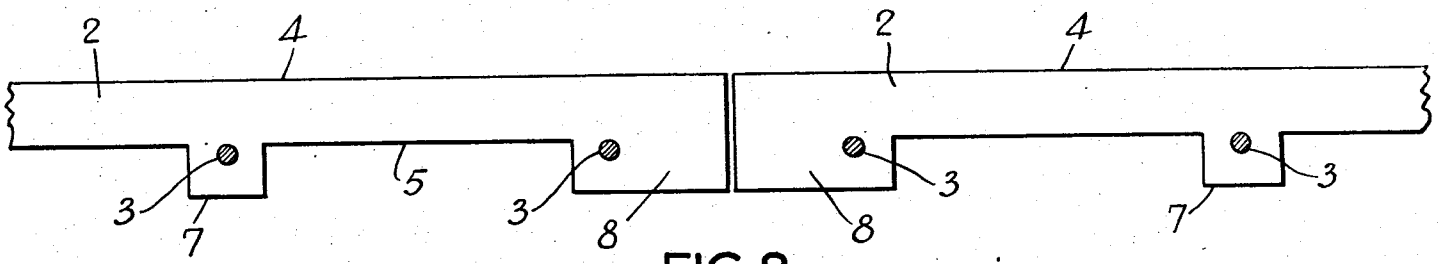
FIG. 8 is an end elevation of a further embodiment of screen mat constructed in accordance with the present invention in which edge parts of two adjacent mats are shown reinforced for efficient jointing.

In the embodiment shown in FIG. 8, parts of two similarly formed and co-planar screen mats are shown in substantially end-to-end abutment; such an arrangement may be required to provide a long or a wide screen on the screen deck. The mats are mounted so that their ribs 7 extend at right angles to the intended direction of flow of material over the screen and the ribs adjacent to the substantially abutting edges are extended to these edges as shown at 8. In this way the abutting marginal edge parts of each screen mat may be reinforced to give a higher degree of rigidity than the remaining portions of the mats, thereby providing an efficient but-joint between adjacent screen mats on the deck.

For certain applications, the screen mat made according to the present invention may be used in the "inverted position" that is to say with the ribs 7 extending upwardly and the surface 5 would receive the material to be screened. In such case the upstanding ribs may serve to reduce and control the flow of material down a steeply inclined screen part. A further advantage of the screen mat in accordance with the present invention is that when the mat is arranged so that the ribs are located on the surface which is subjected to the raw material being screened, if the ribs extend parallel to the flow of raw material they afford a measure of protection to the screen part from damage by impact from large lumps of rock and similar raw material.

Some screen deck units are designed so that the screen mats mounted on them are tensioned in a lengthwise instead of a widthwise direction. Screen mats according to the present invention are equally applicable to these units. In this case the ribs containing the tensioning cables are cast along the length of the screen part 2.

A main advantage of the screen mat according to our invention is the provision on the screen part of greater effective thickness of elastomeric material to resist wear, as compared with a conventional tensioned screen mat, resulting in a longer useful working life. This greater effective thickness provides a further advantage in respect of wear resistance. One of the factors which causes the screen part to wear is the impact load of each piece or particle being screened on the upper surface of the screen part. On a conventional reinforced screen mat the thickness of the elastomeric material which overlies a tensioning cable is reduced, and for a given impacting force therefore the compression of the elastomeric material which overlies a cable is reduced as compared with the compression which would occur in the elastomeric material of the screen mat where it is not reinforced by a tensioning cable. If the yield is less the effective impact load is increased, and therefore the wear on the surface of a conventional screen mat immediately above a tensioning cable is greater than that over the portion of the screen part not reinforced by a cable. This uneven wear results in reduced life. By comparison, in a screen mat according to the present invention, the effective thickness of the material for the screen part may be uniform over the whole of its area and consequently one cause of uneven wear is removed.

A further advantage of the present invention arises when the screen mat is mounted in a screen deck of a very commonly used type which has fixed longitudinal bars on which the screen mat rests. These longitudinal bars rigidly support conventional screens over a considerable area, and reduce their ability to deflect under impact. With a screen mat according to the present invention, the mat may be rigidly supported on the bars only at the small areas where the ribs cross the longitudinal bars, and therefore the body of the screen mat has a greater ability to deflect under impact than a conventional tensioned screen mat. This ability to deflect under impact reduces impact load, and results in improved wear. A further advantage of this ability to deflect is a reduced tendency for the apertures to block up.

A further feature of screen mats according to the present invention as described and illustrated is that screening units or decks may not require modification to enable the screens to be fitted.

Although we have referred throughout the specification to the cables, wires, rods or other elongated tensioning members as being used to tension (alleviate flexing) of the elastomeric body of the screen mat, it will be realised by persons skilled in the art that such members will also serve to reinforce the body of the screen mat.

We claim:

1. A screen mat having a moulded elastomeric body and an elongated substantially inextendable tensioning member extending through said body along a path remote from the side edges of the body, said member being intended to tension the screen mat in use to restrain flexibility of the body, and in which the body comprises a screen part having an upper screening surface and a lower underside surface which is substantially parallel with said screening surface; said screen part having an apertured portion in which are located an array of apertures which communicate between said surfaces, and said screen part carrying a rib which is integrally moulded therewith and is located on said underside surface of the screen part, and wherein said tensioning member extends through the body substantially parallel with said surfaces and is located in the material of the rib and is substantially parallel therewith, said tensioning member being immediately below the underside surface of the screen part, the underside surface of the screen part being substantially tangential to the peripheral surface of the tensioning member, and the tensioning member is, for its longitudinal extent which passes through the rib, substantially enclosed over its peripheral surface by the material of the rib, said rib being co-extensive with at least said apertured portion of said screen part.

2. A screen mat as claimed in claim 1 in which at least two said tensioning members are provided, said members extending in straight paths through the body and in spaced and parallel relationship to each other, said members being respectively located in discrete ribs located on the underside surface of the screen part and being substantially enclosed over their peripheral surfaces by the material of said ribs in which they are respectively located.

3. A screen mat as claimed in claim 1 in which said tensioning member meanders and has straight length parts of its longitudinal extent, said straight parts being in spaced and parallel relationship to each other and being embedded in the material of the ribs located on the underside surface of the screen part.

4. A screen mat as claimed in claim 1 in which the screen part is substantially rectangular in plan and said rib and at least the part length of the tensioning member located therein extends along a straight path which is substantially parallel with, and spaced from, a pair of opposed side edges of the screen part.

5. A screen mat as claimed in claim 1 in which the ends of the tensioning member are encapsulated in the elastomeric material of the body at marginal edge portions thereof.

6. A screen mat as claimed in claim 1 wherein said tensioning member is made of a metallic material.

* * * * *